US005877687A

United States Patent [19]

Bernard et al.

[11] Patent Number: 5,877,687

[45] Date of Patent: Mar. 2, 1999

[54] WEIGHT DISTRIBUTION TRAINING SYSTEM FOR SKIERS AND THE LIKE

[76] Inventors: Corinne Bernard, 86 Winfield Ave., Harrison, N.Y. 10528; Keith Connelly, 1002 E. Short Dr., Ithaca, N.Y. 14850

[21] Appl. No.: 674,346

[22] Filed: Jul. 2, 1996

[51] Int. Cl.[6] ..... G08B 23/00

[52] U.S. Cl. ..... 340/573; 340/539; 340/665

[58] Field of Search ..... 340/573, 539, 340/665, 666; 434/253; 128/779; 455/49.1

[56] References Cited

U.S. PATENT DOCUMENTS

| | | | |
|---|---|---|---|
| 3,644,919 | 2/1972 | Mathauser | 340/573 |
| 4,516,110 | 5/1985 | Overmyer | 340/323 R |
| 4,539,708 | 9/1985 | Norris | 455/49.1 |
| 4,629,181 | 12/1986 | Krive | 272/97 |
| 4,906,192 | 3/1990 | Smithard et al. | 434/253 |
| 5,036,605 | 8/1991 | Marega | 36/121 |
| 5,049,079 | 9/1991 | Furtado et al. | 434/253 |
| 5,086,573 | 2/1992 | Mabboux et al. | 362/2.6 |
| 5,524,637 | 6/1996 | Erickson | 128/779 |
| 5,619,186 | 4/1997 | Schmidt et al. | 340/573 |

*Primary Examiner*—Jeffery A. Hofsass
*Assistant Examiner*—Sihong Huang
*Attorney, Agent, or Firm*—Gottlieb, Rackman & Reisman, P.C.

[57] ABSTRACT

A training aid for skiers or other individuals engaged in physical activity using an athletic apparatus includes a sensor for sensing the force between a skier's leg and his boot. The sensor is arranged to generate an electrical signal indicative of the weight distribution of the skier during skiing. This signal is monitored and if it indicates that the skier's weight distribution is improper, an indication is provided to the skier so that the skier can take corrective measures.

19 Claims, 5 Drawing Sheets

WEIGHT DISTRIBUTION TRAINING SYSTEM FOR SKIERS AND THE LIKE

BACKGROUND OF THE INVENTION

A. Field of Invention

This invention pertains to an apparatus for sensing and indicating weight distribution of an individual using sporting equipment, such as skis and other similar apparatus wherein said weight distribution has an important impact on the ability of the individual to achieve maximum performance.

B. Description of the Prior Art

In many sports activities in which specialized devices are required, an important parameter which affects the operation of the devices is the weight distribution of the individual engaged in said activity with respect to the device(s). For example, a skier riding on a pair of skies downhill must insure that he leans forward sufficiently so that his weight is not supported by the rear portion (i.e., behind the binding) rather than the rear portion of the skis. This weight distribution is important because when the weight is in the front, the individual can control his skis much better than if his weight is in the back. However, at certain instances, especially on steep slopes, even the most experienced skiers may forget to adjust their weight distribution properly and accordingly their performance suffers. Less experienced skiers may lose control of their skis and crash into other skiers or objects thereby risking injury. Similarly considerations are applicable to ski boarders, roller- and ice-skaters, etc.

An attempt has been made in the past to provide an indication when the skier's knee is not positioned correctly (see U.S. Pat. No. 3,644,919). It is also known to measure the strain generated in the skis (see U.S. Pat. No. 4,516,110). However, the inventors are not aware of any devices which measure the weight distribution of a skier (or an individual engaged in another sport) and which indicate the same to the individual.

OBJECTIVES AND ADVANTAGES OF THE INVENTION

In view of the above, it is an objective of the present invention is a training system which provide quick indication to the operator that his weight distribution is improper or correct.

A further objective is to provide a system which can be easily adapted to a variety of devices without making substantial changes in the system.

A further objective is to provide a system which is easy to use so that it can be operated with minimal amount of training. Other objectives and advantages shall become apparent form the following description. Briefly, a system constructed in accordance with this invention consist of a sensor for sensing a force applied between a limb of an individual and an athletic device, said sensor being positioned so that this force is indicative of the weight distribution of the individual with respect to said device. The sensor generates an electrical signal which is fed to a comparator. The comparator compares this signal to a reference and based on the results of this comparison an appropriate signal is provided to a remote indicator. The normal indicator then provides a visual, aural indication, or a combination thereof to the individual when the individual's weight distribution is improper, or correct.

In one embodiment of the invention particularly suited for skiers, the system consists of a skiing aid apparatus for assisting a person improve his skiing abilities while moving downhill on skis, said apparatus comprising means for sensing a weight distribution of said person on said skis; electronic means for generating an electrical signal indicative of said weight distribution; and indicating means for indicating to said person said signal.

Such a system may include a pressure sensor; a mount for mounting said pressure sensor for sensing a weight distribution of a person on a ski while said person is moving on said ski; an electronic processor receiving a signal from said pressure sensor indicative of the weight distribution of said person along a longitudinal axis of said ski, and for generating an output signal indicative of whether said weight distribution is proper in accordance with a preselected criteria; and indicating means for indicating to said person said output signal.

DETAILED DESCRIPTION OF THE INVENTION

Figure 1:
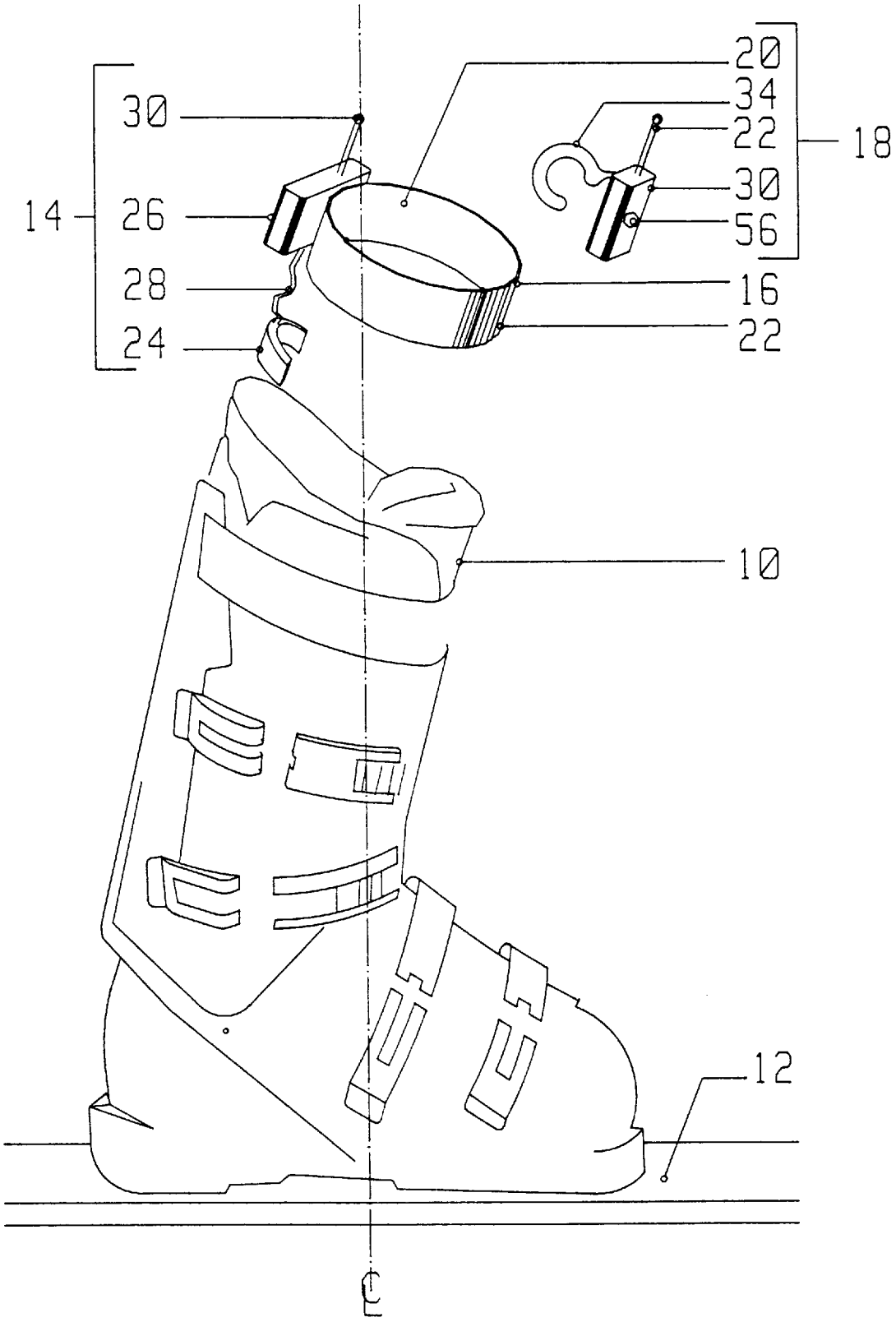
FIG. 1 illustrates somewhat diagrammatically the components of system constructed in accordance with this invention.

FIG. 1 shows a ski boot 10 mounted by bindings (not shown) to a ski 12. Associated with the boot is a training apparatus 14 consisting of a sensor assembly 16 and an indicator assembly 18. The sensor assembly includes a cuff 20 provided at its ends by VELCRO as at 22, so that an individual can attach the cuff 20 to his leg. Preferably the cuff 20 is positioned above the ankle. The assembly 16 also includes a pressure sensor 24 described in more detail later. The sensor 24 is positioned so that when the individual inserts his foot into boot 10, the sensor 24 is disposed between the individual's leg and the boot 10. Alternatively, the cuff 20 can be mounted on the boot 10 with sensor 24 being positioned between the bladder of the boot and the outer shell. If desired, the sensor may be mounted on the boot directly by other means.

Figure 1A:
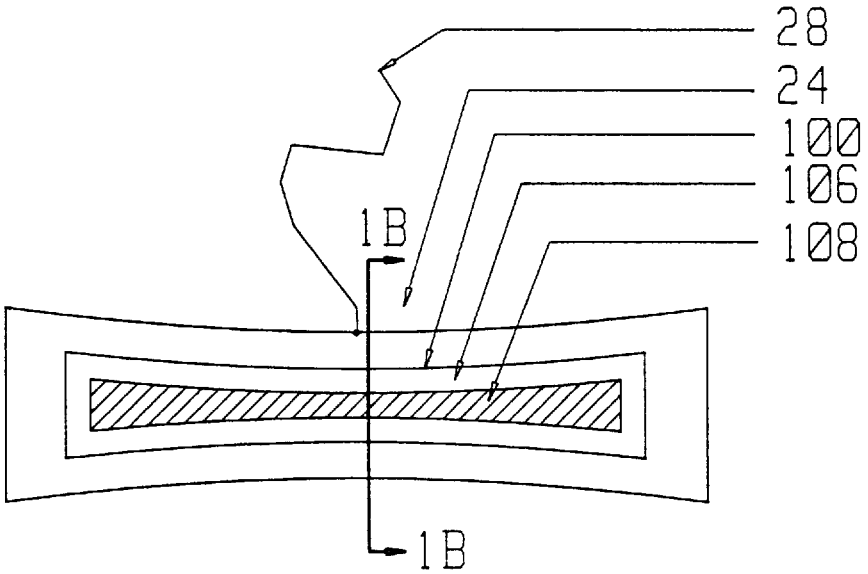
FIG. 1A shows a front view of the sensor of FIG. 1.
Figure 1B:
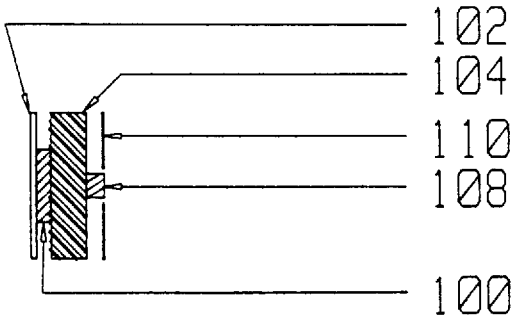
FIG. 1B shows a partial cross-section view taken along 1B—1B.
Figure 1C:
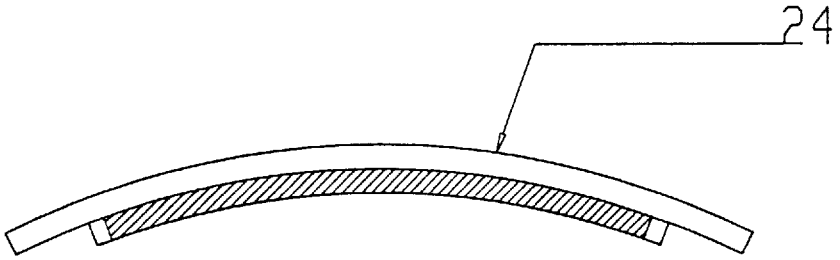
FIG. 1C shows a top view of the sensor.

Referring to FIGS. 1A, 1B and 1C, sensor 24 consists of a thin film sensing element 100 encapsulated in an elastic housing. The housing is formed of a substrate 102, and a relatively soft foam rubber sheet 104. The substrate 102 and sheet 104 are laminated together, with a pocket 106 formed for holding the sensing element 100. Preferably, co-extensive with sensor 100, sheet 104 is formed with a rib 108 made of a rubber material harder than sheet 104. The sheet 104 is covered by a protective nylon film 110, with the rib 108 being adhesively sensed to sheet 104 and extending outwardly of film 110. The whole sensor 24 is curved as seen in FIG. 1C. Pressure or force between the boot and the skier's leg is transmitted by rib 108 to the sensor element 100.

The sensor assembly 16 further includes a casing 26 connected to the sensor 24 by a cable 28 and sensed to cuff 20. Extending outwardly of casing 26 is an antenna 30 for communicating with the indicator assembly 18.

The indicator assembly 18 includes a casing 31 having an antenna 32 for receiving signals from the sensor assembly 16. Casing 31 is further provided with a hook 34 so that it can be attached to the individual's ear.

Figure 2:
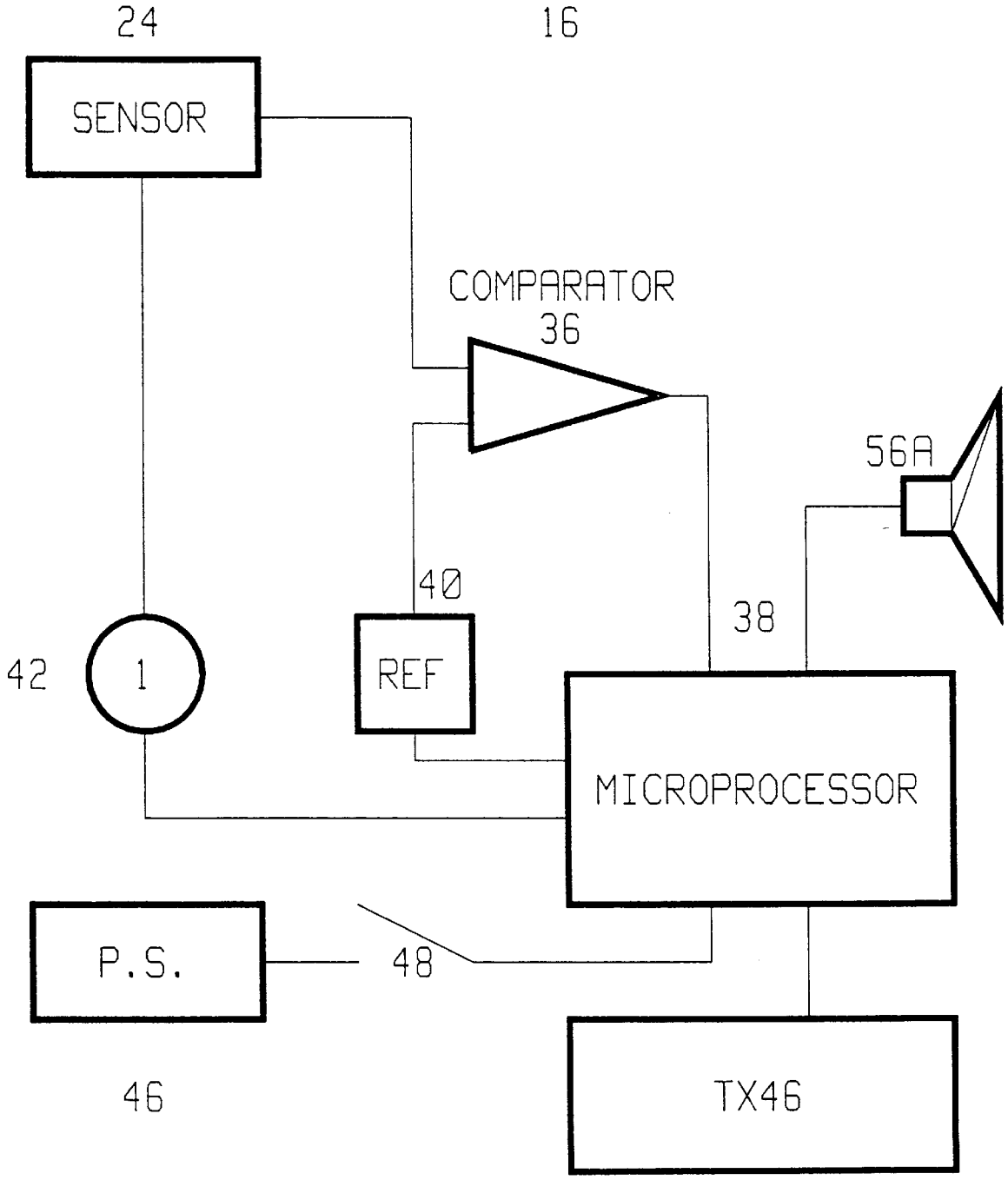
FIG. 2 shows a block diagram of the sensor assembly for the system of FIG. 1.

As shown in more detail in FIG. 2, the sensor assembly 16 includes a comparator 36, a microprocessor 38, a programmable reference source 40, a programmable current source 42 and a transmitter 46. Finally a power supply 46 (preferably a battery) provides power to these elements through a switch 48. Except for sensor 24, these elements are disposed in casing 26 shown in FIG. 1.

Figure 3:
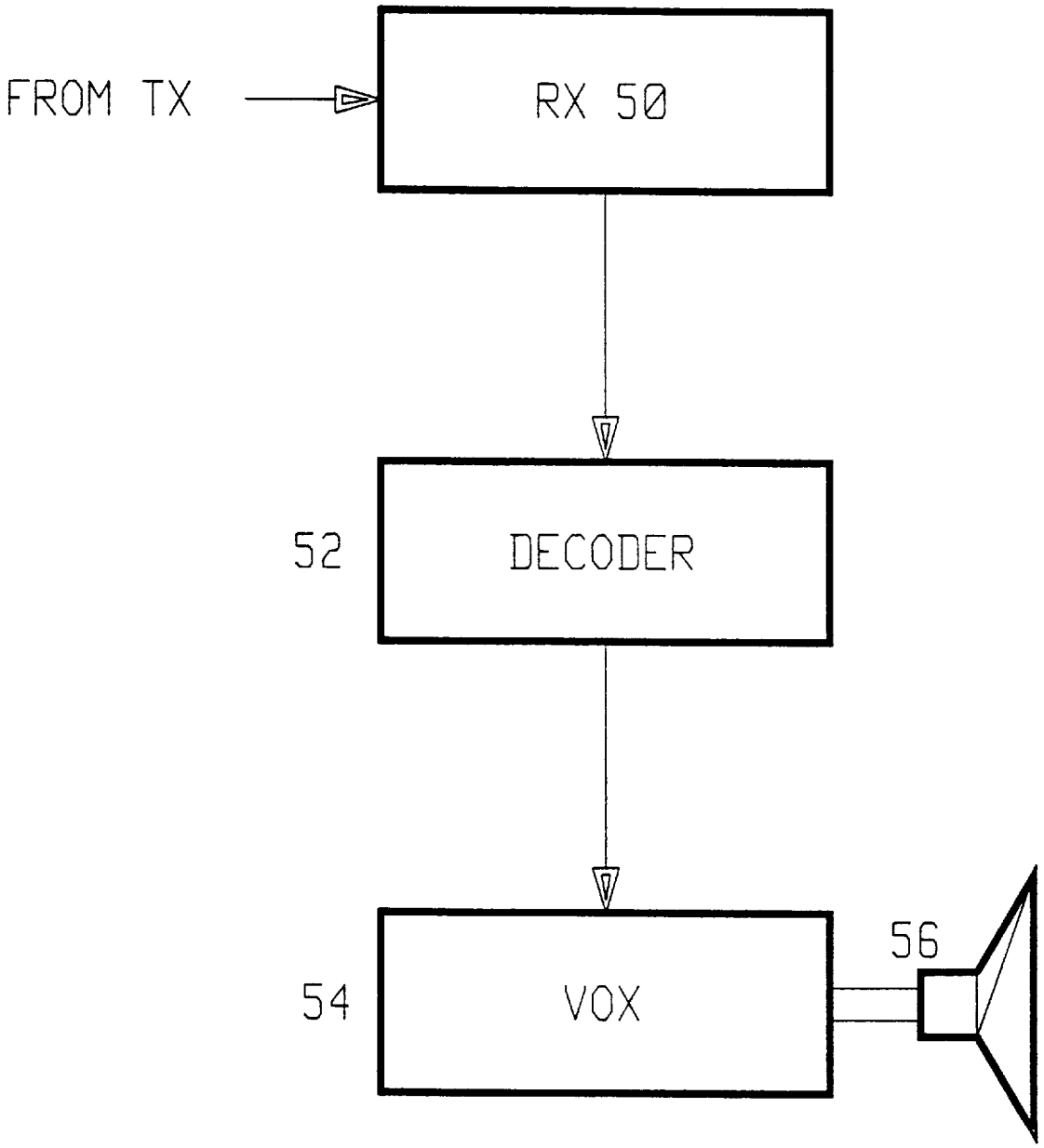
FIG. 3 shows a block diagram of the indicator assembly for the system of FIG. 1.

Referring now to FIG. 3, the indicator assembly 18 includes a receiver 50, a decoder 52, a voice synthesizer 54 and a miniature speaker 56. The speaker 56 may be mounted outside the casing 31 so that it can be positioned adjacent to, or extend into the outer ear of the individual. The assembly 18 also has its own power supply and a switch for activating the same, however these have been omitted for the sake of clarity. The receiver 50 receives signals from the transmitter 46 and sends them to the decoder 52. These signals can be either in the AM or FM radio range, or they could be high frequency signals in the range of 900 Mhz. The decoder verifies that the received signals are valid and then sends corresponding commands to the voice synthesizer 54. The synthesizer then retrieves from its memory (not shown) a sequence of sounds corresponding to the received code.

Figure 4:
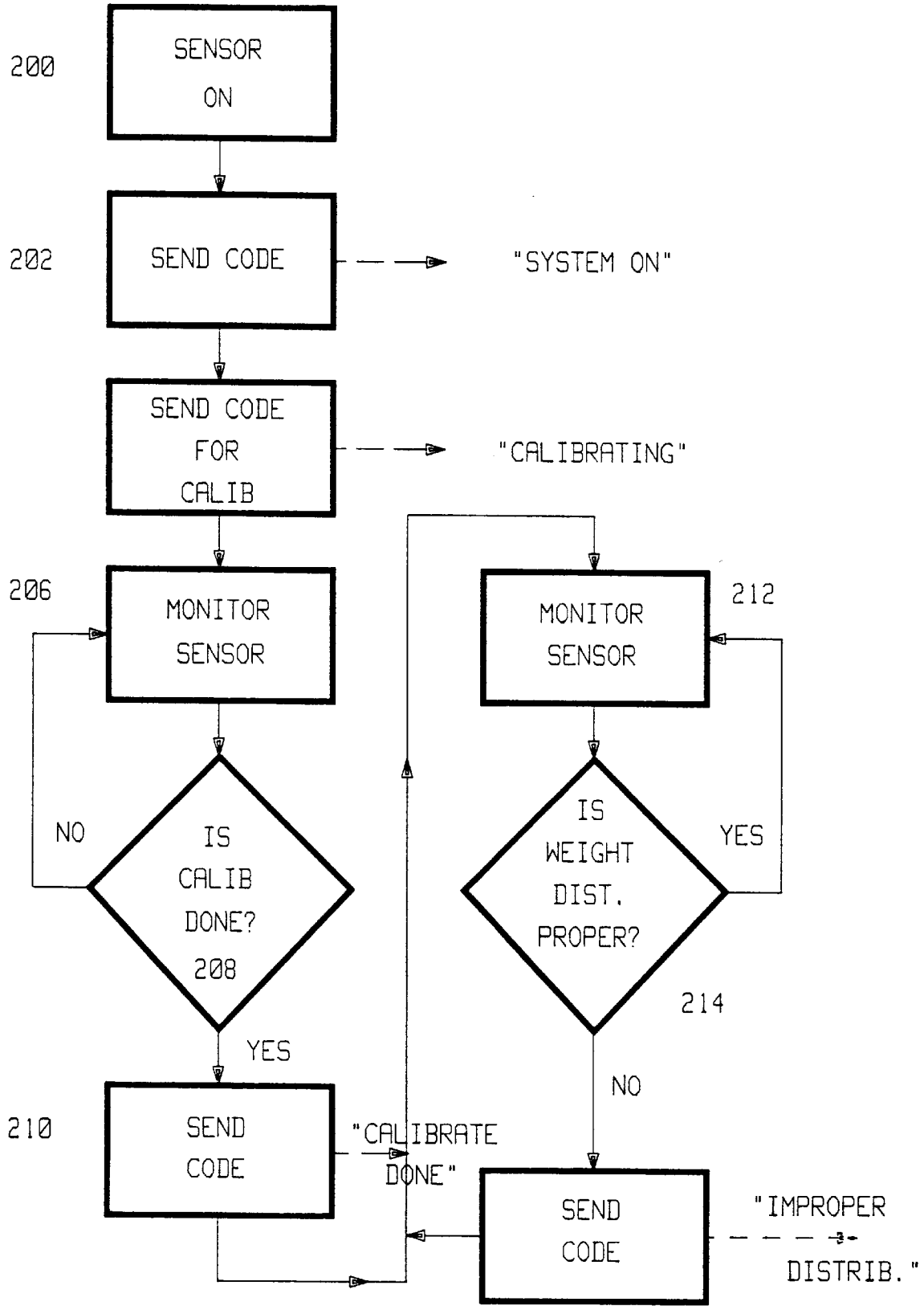
FIG. 4 shows a flow chart for the system of FIG. 1.

The operation of the system 14 shall now be described in conjunction with the Figures so far described and the flow chart of FIG. 4. As previously mentioned, the cuff 20 is first secured to the leg or the boot of the individual. The individual also secures the casing 31 on his ear. He then continues with normal steps necessary to secure the boots to the skis and so on. If he so chooses, the skier may go to the top of a slope before activating the system 14. Once he is ready, the individual closes the power switch of the indicator assembly 18 (not shown) and the switch 48 of the sensor assembly 16 (step 200). Next, the microprocessor 38 sends a code through transmitter 46 to confirm that the system has been turned on-step 202. The receiver 50 receives this code, and provides to the decoder 52 which decodes it and sends a corresponding signal to the voice synthesizer 54. The synthesizer then issues a signal to the speaker 56 indicating the system has been turned on and that the two assemblies 16, 18 are in communication. For example, the individual wearing the system may hear the words 'SYSTEM ON'.

Next, the microprocessor 38 enters into a self-calibration mode. In this mode, the microprocessor first sends a code to the indicator assembly to indicate that the self-calibration is in progress. For example, during step 204 the individual may hear 'CALIBRATING' followed by a sequence of tones increasing in frequency. This is a clue for the individual to set his weight distribution so that it is undesirable or improper. More specifically, as seen in FIG. 1, a vertical axis of gravity C—C (not shown) is passing through boot 10. During calibration, the individual leans backward so that his center of gravity is behind the axis C—C (not shown).

Meanwhile in step 206 the microprocessor monitors the sensor 24. As the individual leans back the sensor 24 detects an increased force. Preferably the sensor element 100 is a thick film type high impedance force sensor made for example by the INTERLINK ELECTRONICS of Camarilo, Calif. 93012. The sensor 24 receives a preselected current from current source 42 and outputs a signal to comparator 36. The comparator 36 compares this output to a preset reference from reference source 40 and if it is larger than said preset reference then a high comparator output is generated. The microprocessor monitors this output (step 208) and if it is low, steps 206, 208 are repeated. In this way the current to the sensor is increase gradually until a new threshold value is derived by the microprocessor which corresponds to the inappropriate or undesirable weight distribution of the individual. When the calibration is completed, the microprocessor sets the reference source 40 to the value obtained from the sensor 24 and sends a code (step 210) to the receiver 50. The indicator assembly issues an indication to the individual that the calibration has been completed. For example the speaker 56 may issue the word 'DONE'.

The skier can now start going down the slope. As he is riding the skis, he is constantly shifting his weight back and forth. (The skier also shifts his weight sideways, but this is not relevant to the present invention). During this stage, the microprocessor 38 monitors the sensor 24 and makes a determination if the individual has shifted to or beyond the weight distribution set during the calibration mode. If the microprocessor detects that the individual has shifted to an improper weight distribution, (step 214) it sends a new code to the receiver (step 216). The microprocessor then returns to step 212. In response to the new code, the indicator assembly issues audio signal indicating to the individual that his weight distribution is wrong (i.e. it is too far back) and that he has to correct it. For example, the speaker may issue one or more beeps of preselected frequencies. This process continues until the individual corrects his weight distribution at which point the beeps are stopped.

The invention has been described in conjunction with a particular embodiment. However, it may be implemented in other ways as well. For example, the sensor may be positioned in other parts of the boot, or alternatively it may be positioned between the boot and the binding, or the binding and the ski.

In another embodiment of the invention, the casing 31 is clipped or otherwise mounted to a ski jacket and speaker 56 is implemented as a miniature earphone, coupled to casing 31 by a pair of thin wires (not shown). In a third embodiment indicator assembly 18 is omitted entirely and the sensor assembly is provided with a speaker 56A (see FIG. 2). The speaker 56A is controlled by the microprocessor 38 and is used to generate beeps for the wearer. This embodiment is cheaper to implement, however, it may be undesirable since the sounds emitted by speaker 56A are heard by other skiers as well and may be distracting.

Similarly, while an rf channel of communication is defined for coupling the sensor and the indicator assembly, other means may be used for this purpose, such as one or more pairs of thin wires. Although the inventors believe that an indicator assembly providing audio signals is most unintrusive, other types of indication may also be provided, such as visual, vibratory and so on, alone or in combination with audio indication signals.

Although the invention has been described with reference to several particular embodiments, it is to be understood that these embodiments are merely illustrative of the application of the principles of the invention. Accordingly, the embodiments described in particular should be considered exemplary, not limiting, with respect to the following claims.

We claim:

1. A skiing aid apparatus for assisting a person improve his skiing abilities while moving downhill on skis, said apparatus comprising:

a sensor for sensing a weight distribution of said person on said skis over a predetermined range and generating a sensed signal corresponding to said weight distribution through said range;

a controller for generating control signals including a request for a self-calibration;

a calibrator for generating a reference signal when said person is in a preselected position resulting in a preselected weight distribution as detected by said weight distribution sensor, said reference signal being generated in response to said request;

an electronic circuit receiving said sensed signal and said reference signal and generating an indication signal dependent on said sensed signal and said reference signal when said person is riding said skis; and an indicator for indicating said indication signal.

2. The apparatus of claim 1 wherein said sensor includes an electronic force sensor.

3. The apparatus of claim 2 further comprising means for mounting said force sensor between a leg of said person and a ski boot.

4. The apparatus of claim 1 wherein said indicator is remote from said sensor and includes a receiver for receiving said indication signal and an audio generator for generating an audio signal corresponding to said indication signal.

5. The apparatus of claim 4 wherein said audio generator includes a speech processor for generating speech signals.

6. The apparatus of claim 1 wherein said calibrator determines said reference signal from said sensed signal when said person is in said preselected position.

7. An electronic skiing aid apparatus comprising:

a pressure sensor sensing a pressure within a range and generating a corresponding pressure signal through said range;

a mount for mounting said pressure sensor for sensing a weight distribution of a person on a ski while said person is riding said ski;

a controller for generating control signals including a request for a self-calibration;

a calibrator for automatically calibrating said pressure signal in response to said request by generating a reference signal when said person is in a preselected position on said skis as detected by said pressure sensor;

an electronic circuit receiving said pressure signal from said pressure sensor indicative of the weight distribution of said person along said ski, and generating an output signal indicative of whether said weight distribution is proper in accordance with a preselected criteria; and an indicator for indicating to said person said output signal.

8. The apparatus of claim 7 wherein said reference signal corresponds to an undesirable weight distribution.

9. The apparatus of claim 8 further comprising a comparator for comparing an instantaneous value of said pressure signal and said reference signal, and wherein said output signal is generated if said instantaneous value is at least equal to said reference signal.

10. The apparatus of claim 7 wherein said indicator includes a receiver for receiving said output signal and a signal generator for generating indication signals corresponding to said output signal.

11. The apparatus of claim 10 wherein said indication signals are audio signals.

12. The apparatus of claim 11 wherein said audio signals are speech signals.

13. The apparatus of claim 7 wherein said indicator is a speaker.

14. An apparatus for indicating a force between a person and an athletic device, said person wearing a boot mounted on said athletic device, said apparatus comprising:

a sensor assembly including a force sensor, a mounting element for mounting said sensor between the person's leg and the boot and a signal processor receiving a sensor signal from said sensor and generating a sensor output signal indicative of the force between said leg and said boot; a controller activated by the person for generating a control signal; a calibrator for automatically generating a threshold value from said sensor output signal when said person is in a predetermined position as detected by said force sensor, in response to said control signal;

a comparator for comparing said threshold value to an instantaneous value of said sensor signal and generating a computer output; and an indicator assembly receiving said computer output and generating a corresponding indicating signal.

15. The apparatus of claim 14 wherein said output signal is generated when said sensor signal has a predetermined relationship to said threshold value.

16. The apparatus of claim 14 wherein said sensor assembly includes a transmitter for transmitting said output signal and said indicator assembly includes a receiver for receiving said computer output.

17. The apparatus of claim 16 wherein said transmitter and receiver transmit and receive rf signals respectively.

18. The apparatus of claim 14 wherein said indicating signal is audio signal.

19. The apparatus of claim 14 wherein said indicator assembly further includes a speech processor for generating audio indicator signals.

* * * * *